United States Patent [19]

Blackston

[11] Patent Number: 4,562,665

[45] Date of Patent: Jan. 7, 1986

[54] BREAKAWAY FOR REVOLVING DOORS

[75] Inventor: Michael D. Blackston, Brooklyn Park, Minn.

[73] Assignee: Heise Mfg., Inc., Minneapolis, Minn.

[21] Appl. No.: 537,272

[22] Filed: Sep. 29, 1983

[51] Int. Cl.[4] ..... E05D 15/02

[52] U.S. Cl. ..... 49/44

[58] Field of Search ..... 49/44, 45, 43, 42; 292/251.5, 144

[56] References Cited

U.S. PATENT DOCUMENTS

| | | | |
|---|---|---|---|
| 2,341,545 | 2/1944 | Hagenbook . | |
| 2,348,900 | 5/1944 | Hagenbook . | |
| 2,523,980 | 9/1950 | Whiteford . | |
| 2,537,418 | 1/1951 | Nordin . | |
| 2,673,108 | 3/1954 | Roller | 292/144 |
| 2,727,772 | 12/1955 | Hamilton | 292/144 |
| 2,954,971 | 10/1960 | Simpson . | |
| 3,020,038 | 2/1962 | Simpson . | |
| 3,045,615 | 7/1962 | Atchison . | |
| 3,285,209 | 11/1966 | Pace . | |
| 3,307,660 | 3/1967 | Sheckells . | |
| 3,308,912 | 3/1967 | Sheckells . | |
| 3,349,876 | 10/1967 | Sheckells . | |
| 3,403,571 | 10/1968 | Sheckells . | |
| 3,473,261 | 10/1969 | Sheckells . | |
| 3,497,997 | 3/1970 | Sheckells . | |
| 3,526,820 | 9/1970 | Sheckells . | |
| 3,717,954 | 2/1973 | Sheckells . | |
| 3,762,098 | 10/1973 | Sheckells . | |
| 3,766,686 | 10/1973 | Sheckells . | |
| 3,793,773 | 2/1974 | Sheckells . | |
| 3,886,684 | 6/1975 | Sheckells . | |
| 3,968,595 | 7/1976 | Sheckells . | |
| 4,054,008 | 10/1977 | Phillips . | |
| 4,063,519 | 12/1977 | Pretini . | |
| 4,070,795 | 1/1978 | Lussier | 49/44 |
| 4,154,023 | 5/1979 | Carroll . | |
| 4,295,297 | 10/1981 | Carroll et al. . | |
| 4,306,744 | 12/1981 | Kreabiel | 292/144 |
| 4,355,830 | 10/1982 | Rau, III | 292/144 |
| 4,372,419 | 2/1983 | Barnett et al. | 292/144 X |
| 4,439,808 | 3/1984 | Gillham | 292/144 X |
| 4,458,447 | 7/1984 | Heise et al. | 49/44 |

FOREIGN PATENT DOCUMENTS 551522 8/1930 Fed. Rep. of Germany .

OTHER PUBLICATIONS

Security Engineering, Inc., Catalog Sheet, Series 3900 Electromagnetic Lock, No Date.

Security Engineering, Inc., Catalog Sheet Series 16.9a/Sc, No Date.

Security Engineering, Inc., Catalog Sheet, Electromagnetic Lock Model 3900, (with photograph), No Date.

*Primary Examiner*—Philip C. Kannan

*Attorney, Agent, or Firm*—Merchant, Gould, Smith, Edell, Welter & Schmidt

[57] ABSTRACT

A magnetic door breakaway system for remote unlocking of doors and apertures. An electromagnet (80), and armature (82) are mounted within a doorframe. Within either the magnet or armature are depressions (220) and (222) in one member and lands (206) and (208) in the other. In the preferred embodiment, the armature is movably affixed to the top of the doorframe and with energizing of the electromagnet, the lands mate with the depressions, making movement of the door impossible. In an emergency situation, the magnet is de-energized, the two members separate, and the door may open freely.

In an alternative embodiment, an electromagnet (304) is connected to a plunger (310) which is received within the striker plate (320).

2 Claims, 18 Drawing Figures

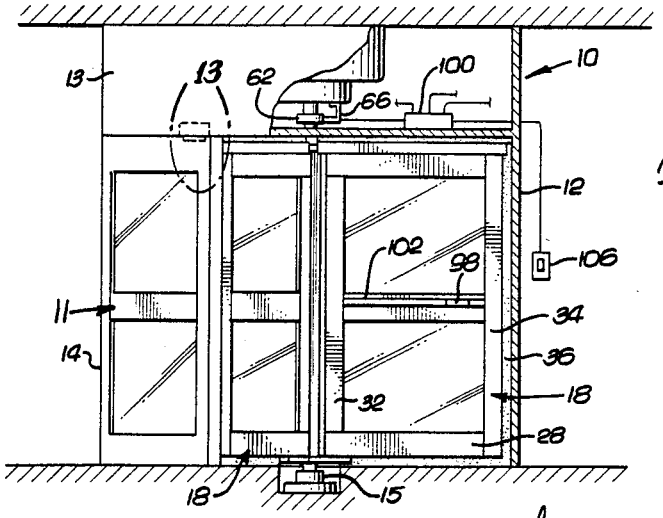
FIG. 5
FIG. 6
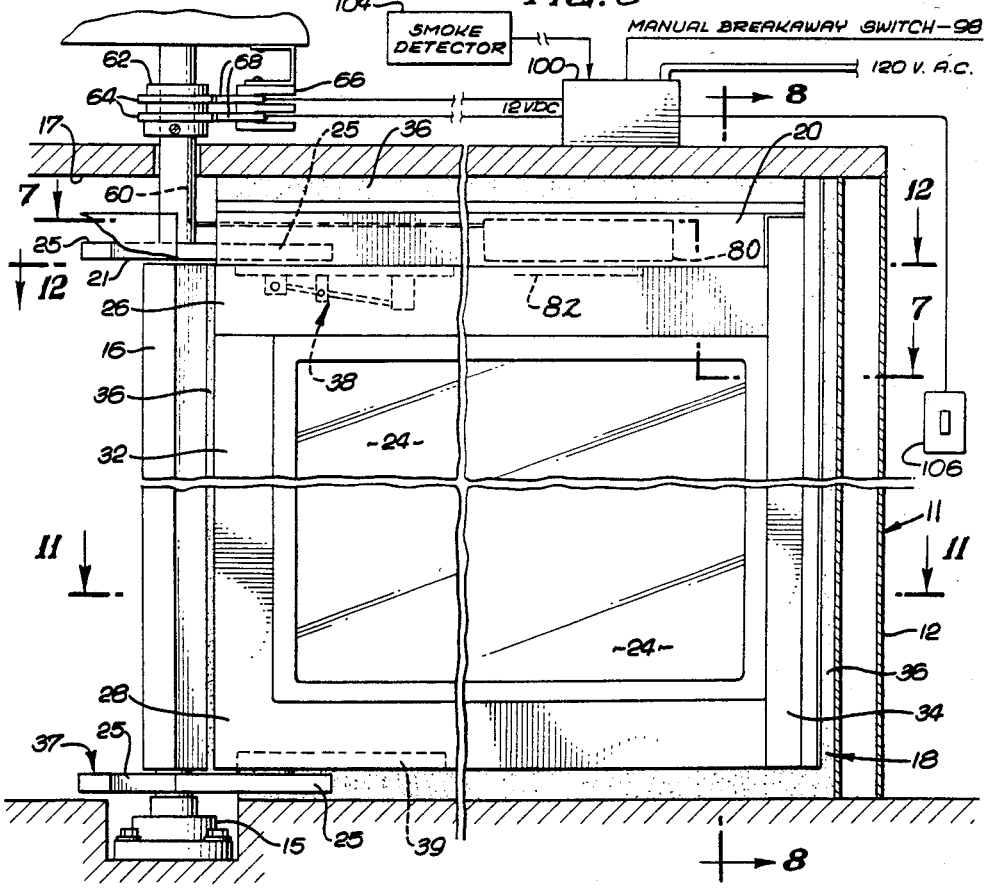

FIG. 14
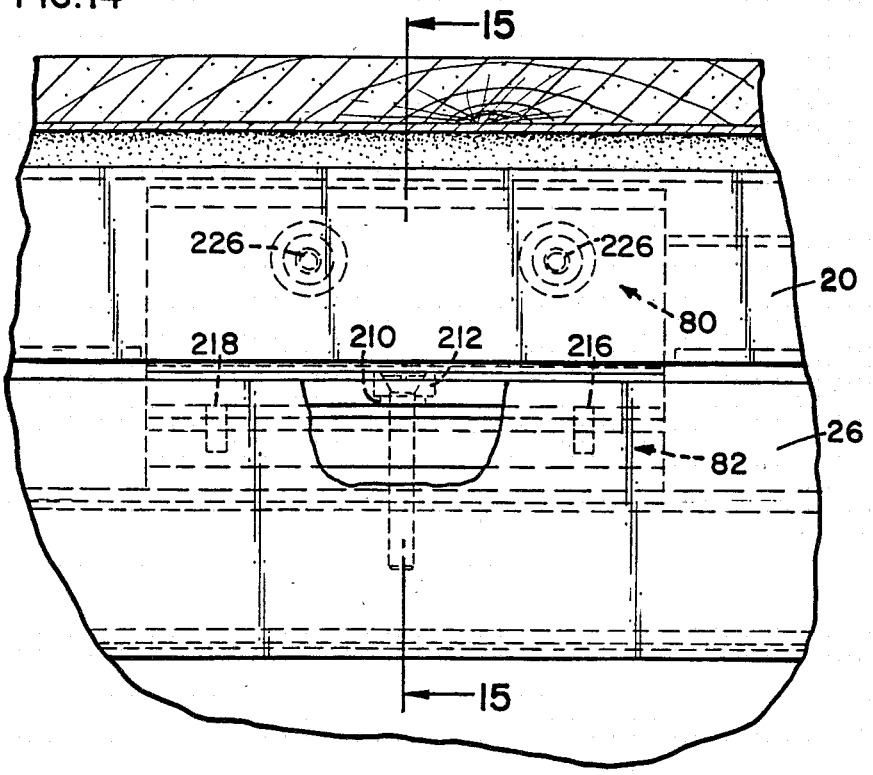
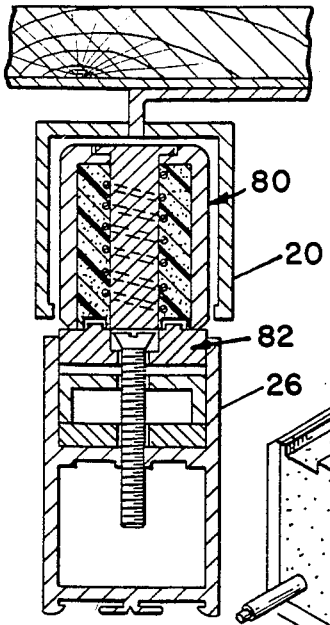
FIG. 15
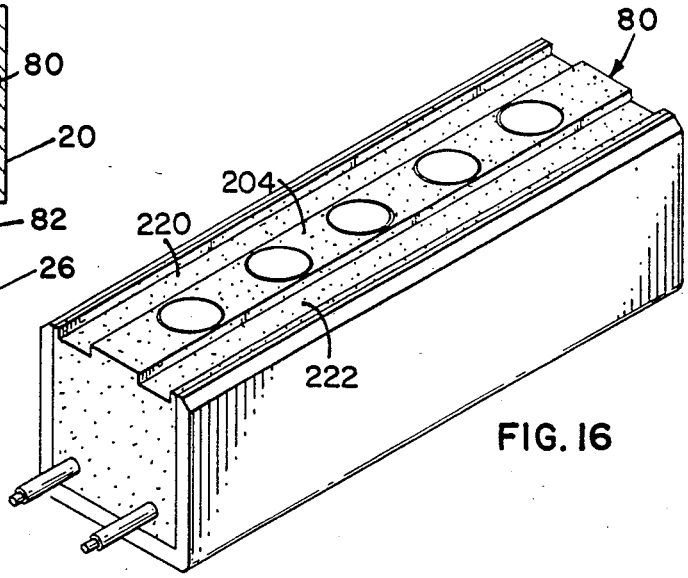
FIG. 16

BREAKAWAY FOR REVOLVING DOORS

FIELD OF THE INVENTION

This invention relates to systems for unlocking doors or other apertures remotely. More particularly, the preferred application of this invention relates to releasing systems for collapsing and folding of revolving door wings in emergency situations.

BACKGROUND OF THE INVENTION

Revolving doors have long been useful in providing ingress and egress to buildings while minimizing the temperature differential losses from the building's interior to exterior ambient air. One concern with the use of revolving doors is that in case of fires or other emergencies, the capacity to let people out of the building is limited. Much of the frontage traversed by the door cannot be used to permit escape from the building. This is recognized in building codes requiring exit door frontage in addition to that provided by any revolving doors.

To increase the ability to allow people to escape in a panic situation, revolving doors having collapsible wings have been used. Typically, such doors have been designed for an individual to purposefully actuate an emergency breakaway option integrated into the revolving door.

A problem which has existed with collapsible revolving doors is that of stack pressure. That is the difference in air pressure created between the exterior of the building and the air within the building. There is generally a temperature difference between that of the air inside and outside. This is as a result of the external ambient environment and the space conditioning system within the building, either making the interior at a warmer or cooler temperature than the outside ambient conditions. The greater density of the colder air with respect to that of the warmer air causes the pressure differential. When the door rotates, only a small portion of the air in the building escapes. In fact, this indeed is one of the advantages of using revolving doors as it entrains the internal ambient environment to a great extent, thus economizing on energy costs by preventing escape of the internal ambient environment from the building.

But there is a sensitivity problem. The doors must be adjusted so that the collapsing feature may be actuated by even the frailest of individuals, yet it must not be actuated in non-panic situations. The collapsing feature must not require active thinking of the person seeking egress from the building. The stack pressure referred to above creates a problem, because it can be sufficient to actuate the collapsing feature. But if the sensitivity to the pressure is reduced, then the weak individual will be unable to cause the collapsing feature to actuate in an emergency situation.

Electromagnetic latches such as that described in U.S. patent application Ser. No. 374,899, filed 4 May 1982, provide a solution to the above problems and allow for remote (electrical) actuation of the latch. Electrical devices must have backup battery power supples to be operable during a power failure so power consumption is a major consideration. To reduce power draw the magnet can be made larger, and thus more efficient. Size eventually becomes a production and installation problem, however. Therefore the optimum magnetic latch has a very high resistance to horizontal shear force, is small, and uses little energy when energized.

SUMMARY OF THE INVENTION

The invention relates to a magnetic latch for use in securing a panel, such as a door in a revolving door arrangement, wherein the latch includes an armature and a magnet element each having a front face, one of the elements having at least one groove therein and the other having at least one projection to be received within the groove. One of the elements is located below the other with their faces in generally parallel planes with the other element being free to more vertically so that when power is applied to the electromagnet, the lower element is pulled up into contact with the upper element with groove and projection engaged creating a physical resistance to horizontal shear force.

According to another aspect of the invention, an electromagnetic latch for securing a panel such as a door in a revolving door system is provided having means responsive to an electrical signal for extending or withdrawing a latch pin from a striker.

According to a further aspect of the invention, a proximity switch may be associated with the rotating of the doors during an emergency situation when they are broken away.

According to a further aspect of the invention, a reset circuit of a type well known in the art may be associated with the proximity switch, to prevent accidental restarting of a revolving door rotating device, until the system is physically reset.

BRIEF DESCRIPTION OF THE DRAWINGS

A better understanding of the invention may be had by reference to the following description taken in conjunction with the accompanying drawings in which:

FIG. 5 is a cross-sectional view with portions exposed and portions removed taken along lines 5—5 of FIG. 3;

FIG. 6 is a detailed cross-sectional view with portions broken away of the invention depicted in FIG. 1;

FIG. 14 is a partial cross-sectional plan view of the electromagnetic latch installed in a door and frame;

FIG. 15 is a view taken along lines 15—15 of FIG. 14;

FIG. 16 is a perspective view of the electromagnet shown in FIG. 15;

DETAILED DESCRIPTION

Figure 1:
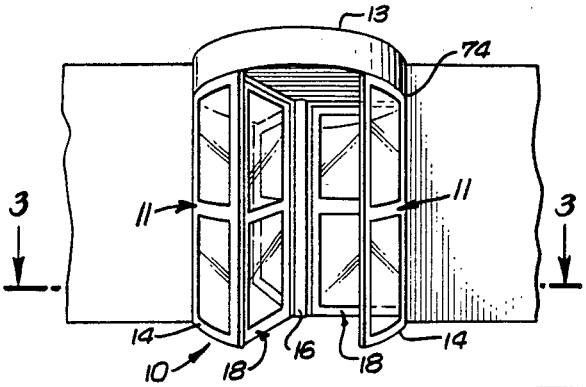
FIG. 1 is a perspective view of the invention.

With particular reference to FIG. 1 through FIG. 13, a revolving door system in accordance with this invention generally comprises a drum 10 having a plurality of upright curved substantially semicircular walls 11, including opposing central panels 12, disposed in facing relationship and adjacent side panels 14 adjoining the opposing central panels 12. A canopy 13 covers the walls 11. The semicircular walls 11 are disposed on opposite sides of the drum 10. The space between the opposing semicircular panels 11 provides a limited region for ingress and egress from a building structure.

Figure 11:
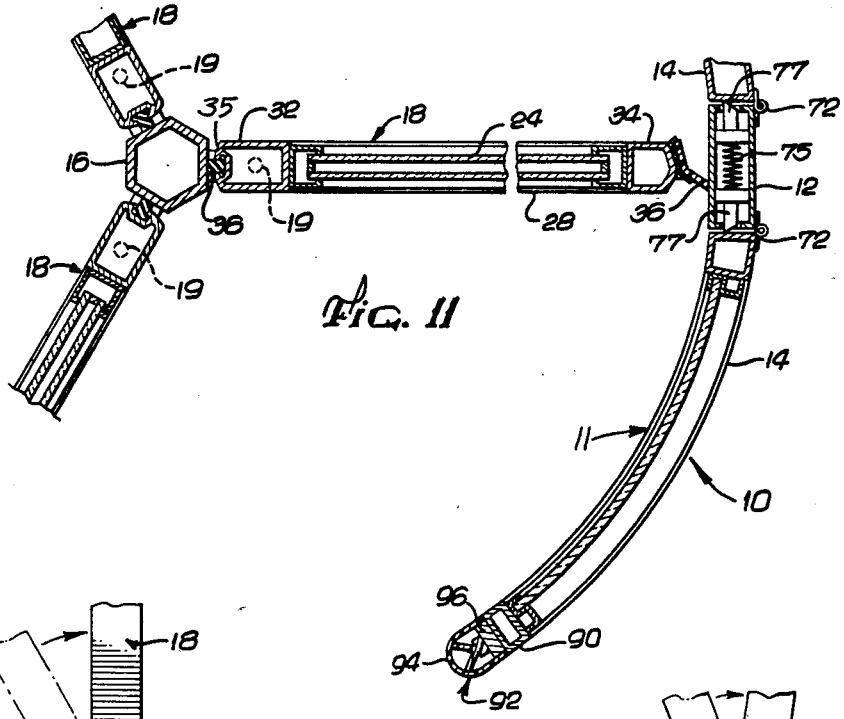
FIG. 11 is a cross-sectional plan view of the invention taken along lines 11—11 of FIG. 6.

Disposed central to the drum 10 is a rotatable central upright shaft 16 defining a central axis, and extending from a floor bearing 15 and through a ceiling 17 of the drum 10. The shaft 16 may be cylindrical as in FIG. 3 or of other cross-section as shown in FIG. 11. Three upright planar door panels or wings 18 are radially positioned about the shaft 16, and thus about a central door axis and are disposed in an arcuate spaced apart relationship of 120°. As best viewed in FIG. 12, the wings 18 are pivotally coupled about pivots 19 adjacent the shaft 16 to provide for the collapsibility of the wings 18 in an emergency situation.

Figure 3:
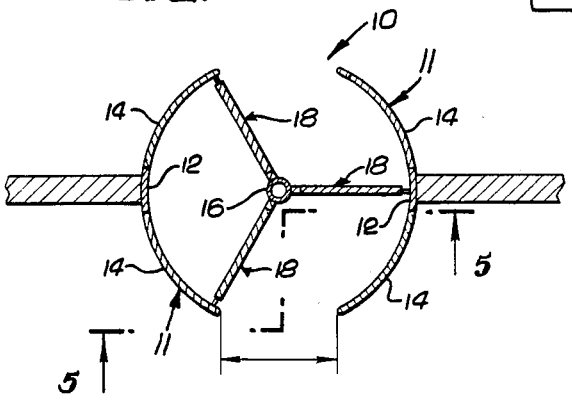
FIG. 3 is a cross-sectional plan view taken along lines 3—3 of FIG. 1.

To maintain the wings 18 in a normally fixed relationship to the shaft 16 as in FIG. 1, FIG. 3 and FIG. 11, three wing hangers 20 extend radially in spaced apart equidistant relationship cantilevered adjacent to the central shaft 16. As best viewed in FIG. 8, the wire hangers 20 comprise elongated aluminum tubes of square cross section. Thus, each wing hanger 20 extends outwardly and radially from the shaft 16 and is spaced apart 120° from the other two wire hangers 20. The hangers 20 are coupled to the shaft 16 by a three arm top spider 21. The top spider 21 is fastened to the shaft 16 by screws 23. Three arms 25 extending radially from the top spider 21 are each inserted in and fastened to the hanger 20 as viewed in FIG. 7 and FIG. 8.

The wings 18 comprise glass panels 24, and are supported by a frame comprising a top rail 26 parallel and adjacent to the wing hanger 20, a bottom rail 28 at the lower portion of the wing 18, and a mid-rail 30 spacing apart upper and lower glass panels 24. In addition, an inner upright stile or rail 32 bounds the glass panels 24 adjacent the shaft 16, and an outer upright stile or rail 34 is adjacent to the drum 10 as shown in FIG. 11. The inner upright rail 32 does not actually contact the shaft 16, as viewed in FIG. 11, but rather weatherstripping 36 disposed along the upright side 35 of the rail is disposed adjacent the shaft 16.

Figure 12:
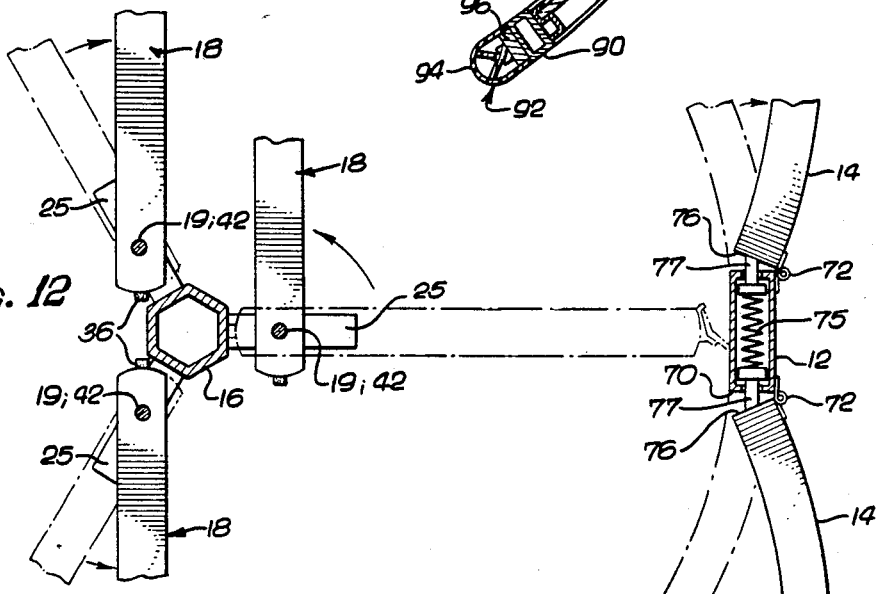
FIG. 12 is a cross-sectional plan view of the invention taken along lines 12—12 of FIG. 6.

A bottom spider 37 comprises a planar laterally disposed element having three arms 25. The bottom spider 37 is coaxial with and rigidly affixed to the shaft 16 in spaced apart relationship to the upper spider 21. The bottom spider 37 pivotally supports each of the doors about the center shaft axis. The spacing between the pivot axis and the shaft axis is sufficient to allow clearance of adjacent inward portions of the wings 18. This allows the folding or collapsing of the doors, as depicted in FIG. 12, without interference of the portions of the wings 18 adjacent to and against the center shaft 16. Note that it is desirable to have sufficient clearance to allow rotation of the wings 18 about pivots 19 in excess of 90°.

Figure 9:
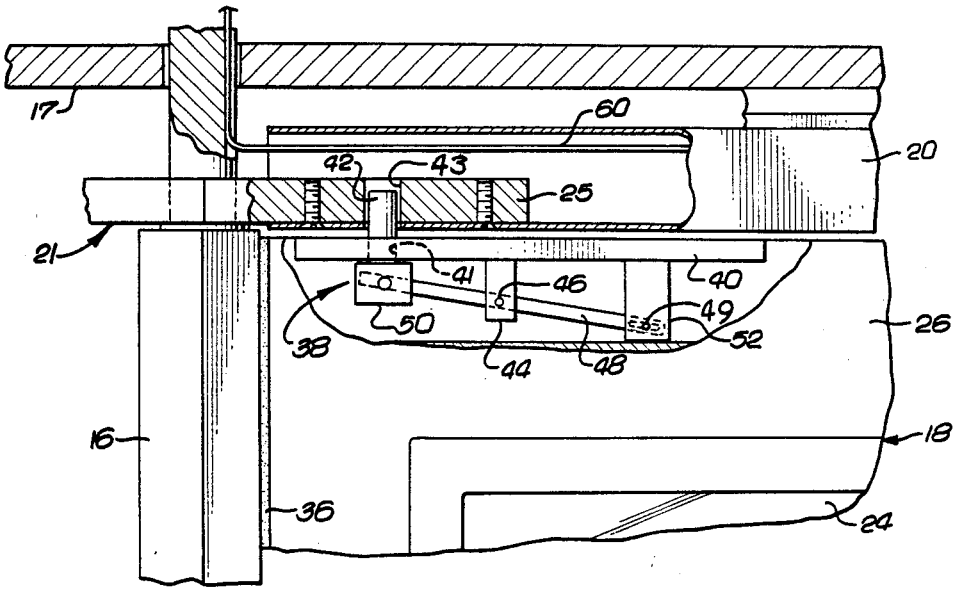
FIG. 9 is a detailed elevational view with portions exposed and portions removed of a portion of the invention depicted in FIG. 6.
Figure 10:
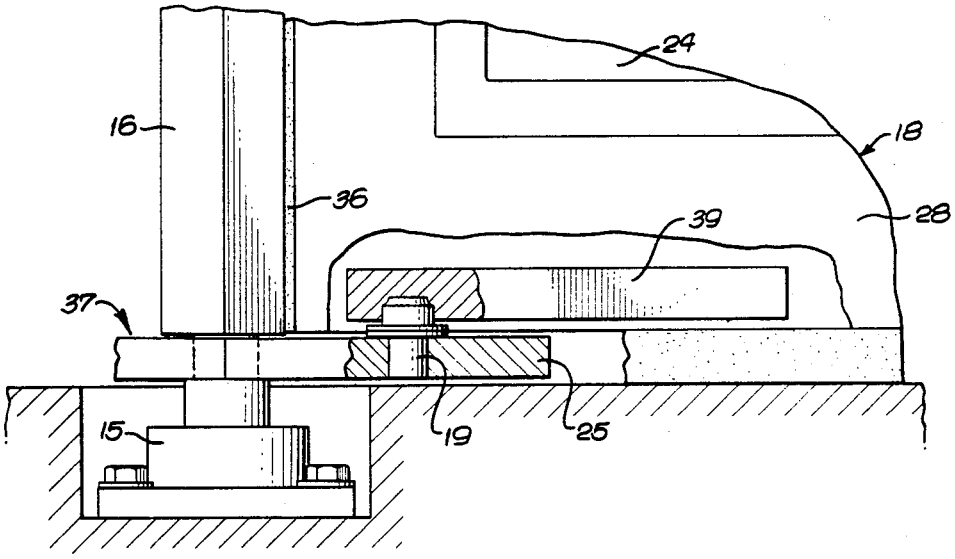
FIG. 10 is a detailed elevational view of a portion of the invention depicted in FIG. 6.

As viewed in FIG. 9 and FIG. 10, the wings 18 are pivotally coupled to the top and bottom spiders 21, 37. A pivot 19 extends upwardly from the bottom spider arms 25. An aperture block 39 defines a pivot aperture disposed within the bottom rail 28. The pivot 19 is rotatably disposed in the pivot aperture of the aperture block 39. The wings 18 are rotatable about the pivot 19 to define the vertical pivot axis. On the top rail 21, a walking beam pivot assembly 38 includes a laterally disposed plate 40 having a rod aperture 41 and a pivot 42 vertically disposed through the rod aperture 41. The plate is fixed to the top rail 26 of each wing 18, though, alternatively, the plate could be joined to each hanger 20. A fulcrum bar 44 is disposed in spaced-apart relationship to the pivot 42 and extends normally from the plate 40 opposite the direction in which the pivot 42 extends from the plate 40. The fulcrum bar includes a fulcrum pivot 46. A lever arm 48 is pivotally coupled to a rod block 50 which is joined to the pivot 42. A control bar 52 is coupled to the plate 40 spaced apart from both the pivot 42 and the fulcrum bar 44. The lever arm 48 has a slotted aperture coupled through a pin 49 to the control bar 52. Removal of the pin 49 from the control bar 52 permits movement of the lever arm 48 and further allows the pivot 42 to retract from the pivot aperture 43. The walking beam pivot assembly 38 allows the coupling of the wings 18 to the top spider 21 allowing the pivot 42 to move into a pivot aperture 43 of the hanger 20 and the spider arms 25, after the wing 18 has already been placed on the pivots 19 of the bottom spider 21. Absent any further structure, the wings 18 could thus move and pivot freely such as to the position as shown in FIG. 12.

However, under normal conditions, the wings 18 should be spaced at 120° and rotate in a fixed position with the shaft 16. As viewed in FIG. 6, this is achieved by utilizing a latching arrangement disposed along the wing hanger 20 and spaced apart from the pivots 19, 42 more remote from the central axis of the center shaft 16. Preferably, the latching arrangement comprises an electromagnet 80 disposed within the wing hanger 20 and a mating armature 82 disposed within the top rail 26 as shown in FIG. 6.

Electromagnet 80 and armature 82 are shown in detail in FIGS. 14–17. In the preferred configuration, the electromagnet 80 is above the armature 82 (with respect to gravity) although it is possible to reverse this arrangement and still obtain the same effect albeit with some reduced efficiency. The electromagnet and the armature can, for example, be a Model 3900 electromagnetic lock supplied by Security Engineering Inc. of Forestville, Conn. 06110, modified as indicated herein. In the manufacturer supplied electromagnetic block, the front faces 202 and 204 of the armature and electromagnet respectively are provided with smooth planar surfaces. The present invention in one embodiment cuts at least one depression in one of the elements (80 or 82) and creates corresponding lands or projections in the other element so that when the elements are brought together, the projection and depression mate. In the preferred embodiment, projections are made in the armature 82 in the form of a pair of parallel lands 206 and 208. The armature also includes central aperture 210 and a recess 212 concentric therearound, extending part-way through from the front face creating a countersunk hole. A fastener (not shown) can be put through aperture 210 such that its head is not in abutment with recess 212. This permits the armature 82 to travel vertically toward the electromagnet 80 when said magnet is energized. To ensure that the armature does not bind within the door frame when moving in the vertical direction, guide pins 216 and 218 are provided on the back surface of the armature, to be received within like holes in the door. In the preferred embodiment, the lands are approximately 1.6 mm high and 5.7 mm wide. The armature is approximately 14 cm in length overall.

The electromagnet, in the preferred embodiment, has a pair of parallel depressions 220 and 222 across the front face 204. The depressions in the preferred embodiment are approximately 2.4 mm deep and 8.1 mm wide. The magnet is mounted within the carrier (above door) by a pair of fasteners which thread into aperatures 226 in a side wall of the magnet.

Without the depressions and projections, the shear holding force of the electromagnet and armature is about 500 kilograms at 200 ma. at 12 volts D.C. With the improvement, the shear force is increased virtually without limit, being determined primarily by the strength of the metal in contact. Furthermore, the current consumption is reduced for an equivalent size magnet since force need only be great enough to draw the components together so that the projections and depressions mate. The magnetic force need not be sufficient to resist the shear because the shear strength is primarily mechanical, not magnetic. In order to maintain the wings 18 in a latched condition with respect to the hangers 20, the electromagnet 80 must be energized. Power to the electromagnet 80 is supplied by wiring 60 which is disposed within the hangers 20 and then passes upward through the shaft 16. A commutating collar 62 coaxial with the shaft 16 and above the ceiling 17 is coupled to the wiring 60. The collar 62 has two circular contacting rings 64. A brush support 66 has a pair of spaced apart contactors or brushes 68 mating with the contacting rings 64. The brushes 68 are coupled to a power source, such as 12 volts D.C., to power the electromagnet support. The brushes are typically copper. The brush support 66 may be spring loaded to bias the brushes 68 against the contacting rings 64.

Figure 2:
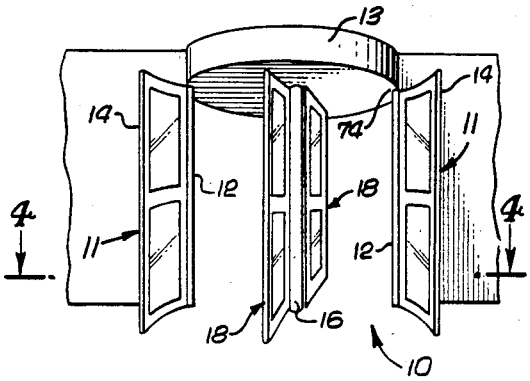
FIG. 2 is another perspective view of the invention depicted in FIG. 1.

With particular reference to FIGS. 2 and 12, opposing central panels 12 have upright side edges 70. An upright longitudinal piano hinge 72 is joined at each upright side edge 70 of the central panels 12. The opposing central panels 12 are joined at the top to a face 74 of the drum 10, adjacent the ceiling 17. The adjacent side panels, 14 have an upright longitudinal edge 76 adjacent to and coupled to the opposing central panels 12 so that the adjacent side panels 14 can pivot outwardly about the upright longitudinal hinges 72. One or more springs 75 bear on plungers 77 extending from the curved panels 12 to bear on the side edges 70 of the panels 14 to bias the side panels toward an opening position. On the ceiling 17 of the drum 10 remote from each of the adjacent side panels 14, are disposed electromagnetic latch arrangements 78 similar to the electromagnetic latch arrangements previously described, as shown in FIG. 6. The electromagnetic latch arrangements 78 comprises an electromagnet 80 and an armature 82. For maximum holding leverage, the latch arrangements 78 are disposed remote from the hinges 72, as viewed in FIG. 12 and FIG. 13.

The adjacent side panels 14 have outermost vertical rails 90 which are upright and extend to expose the ingress and egress openings of the revolving door. The outermost rails are typically aluminum tubing. Extending from the outermost rails is a rubber bumper 92 along the length of the outermost rails 90. The rubber bumper 92 comprises a longitudinal U-shaped portion 94 and is in communication with a ribbon switch 96. The ribbon switch 96 is a safety device which may cause the actuation of a brake to prevent further rotation of the shaft 16 and the wings 18.

A manual breakaway switch 98, as depicted in FIG. 5 may be used in connection with the breakaway arrangement described. It is generally preferable to use some form of relay or sensor coupled to a controller arrangement 100 to cause deactuation of the electromagnets, 80 or other releasing arrangement. For example a smoke detector may be used to supply a signal or other indication to cause deenergization of the electromagnets, 80. However, in some embodiments, it may be desirable to require some nominal effort on the part of an individual to cause the opening of the side panels 14 and the folding of the wings 18. By way of example, the switch 98 may be coupled to mechanical panic hardware attached to the door leaf. This is a bar 102 on the actual door leaf, running across the width of the door. When pressed, the panic bar actuates the switch 98, such as a microswitch, reed switch or proximity switch. Thus, in these examples, concurrent with this switching, a signal is also received from a smoke sensor 104, sprinklersensor or any other form of emergency sensing device or upon actuation of a key switch 106 or smoke alarm button, a solenoid lock or the like in the top rail 20 of the wing 18 will release and permit the wing to fold into the breakaway position.

When the revolving door in accordance with this invention is disposed within a building structure, ingress and egress is provided through the spacing between the adjacent side panels 14 of the facing circular panels 11. Normally the electromagnets, 80 remain energized. Thus, when an individual causes one of the wings 18 to move, the associated wing hanger 20 along with the shaft 16 also moves. Since the other electromagnets 80 are also energized, the other wing hangers 20 and their associated wings 18 also rotate. In addition, the opposing central panels 12 and the adjacent side panels 14 define a nominally closed position, retaining their opposing semi-circular configurations. Neither the wings 18 will collapse forward, nor will the adjacent side panels 14 collapse in this situation, irrespective of the stack pressure, whether the exterior be colder or warmer than the air in the building structure.

Figure 4:
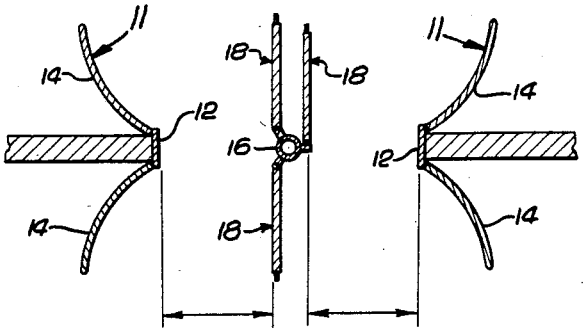
FIG. 4 is a cross-sectional plan view taken along lines 4—4 of FIG. 2.
Figure 7:
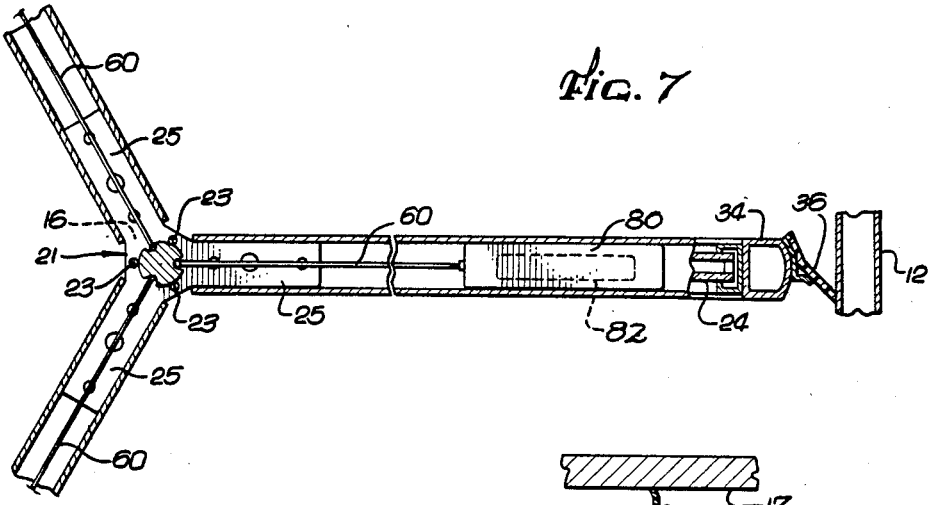
FIG. 7 is a fragmented cross-sectional plan view taken along lines 7—7 of FIG. 6.
Figure 8:
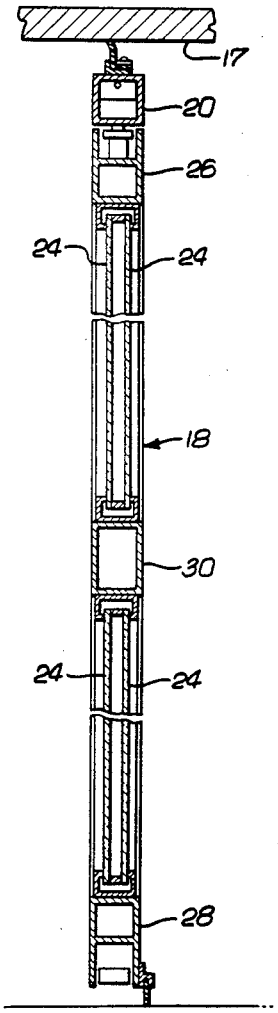
FIG. 8 is a fragmented cross-sectional view taken along lines 8—8 of FIG. 6.

In the event that an emergency does arise, however, the electromagnets, 80 are deenergized. This allows the wings 18 to be moved about the pivots 19, to the positions such as shown in FIG. 2, FIG. 4 and FIG. 12. Similarly, the adjacent side panels 14 are free to move outward and are further biased to open outwardly moving about the upright longitudinal hinges to a nominally open panic position. This panic position significantly increases the linear frontage available for emergency exiting of persons from the building, rather than confining the flow of people leaving the building. More than double the linear footage is available for people to enter the revolving door region and exit the revolving door region. In addition, the limited confined area remains reduced only in the region of the opposing central panels 12 as opposed to the outwardly extending panic position of the adjacent side panels 14.

ALTERNATE PREFERRED EMBODIMENT

Figure 18:
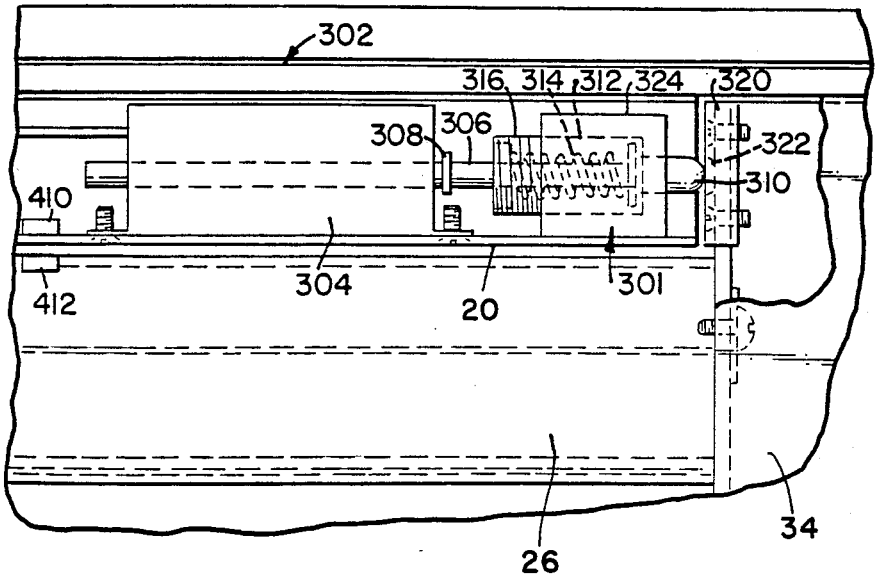
FIG. 18 is a side plan view of an alternate preferred embodiment of the solenoid and striker mounted in a door and frame.

An alternative to the electromagnet 80 and armature 82 combination above, is an electromechanical latch of the type shown in FIG. 18 and designated generally by the numeral 302. The electromechanical latch includes an electrical solenoid 304 with an armature 306 having a stop plate 308. The armature 306 is connected to the plunger 310 and is through the body of the spring latch 312. The spring latch includes the plunger 310, a coil spring 314 and end cap 316 having an aperture (not shown) therethrough which permits the armature to pass therethrough to the plunger. The spring latch 301 is modified from a commercially available product made by Northwestern Tool, Daytona, OH BPN-10 Spring Plunger.

Plunger 310 is aligned to mate with striker plate 320 which has a depression 322 to receive the plunger 310. The spring latch 301 has a threaded body which is received within a mounting block 324 which, like the solenoid 304, is mounted, preferably on or in the door carrier. The striker plate is preferably mounted in the door frame, although these positions can be reversed.

In operation the spring force on the plunger 310 is sufficient to maintain the door in a locked position against light force 0–30 lbs (0–13.5 Kg). When power is applied to solenoid, the plunger engages depression 322 with a force proportional to the voltage applied to solenoid 304. Essentially whenever power is applied to solenoid 304, the door is locked. However, a fire, power failure or panic situation which causes interruption of power to the solenoid 304 will allow egress through the then unlocked door.

If higher security is required, the operation of the solenoid can be reversed so that, when the solenoid is energized, armature 306 is drawn into the solenoid against the force of spring 314, thereby removing the plunger 310 from the striker plate 320. In this embodiment, spring 314 would have sufficient spring force to maintain the door in a locked position when no power was applied to the solenoid. Although this configuration would be inoperative without power, a back-up battery power pack can solve this problem. The benefit, however, of this modification is the door will be secured for longer periods in the event of a power failure since the back-up power supply is only required to open the door, and no power is required when the door is locked.

Figure 13:
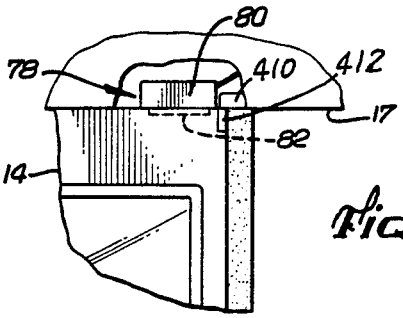
FIG. 13 is a detailed elevational view of a portion of the invention as depicted in FIG. 5.
Figure 17:
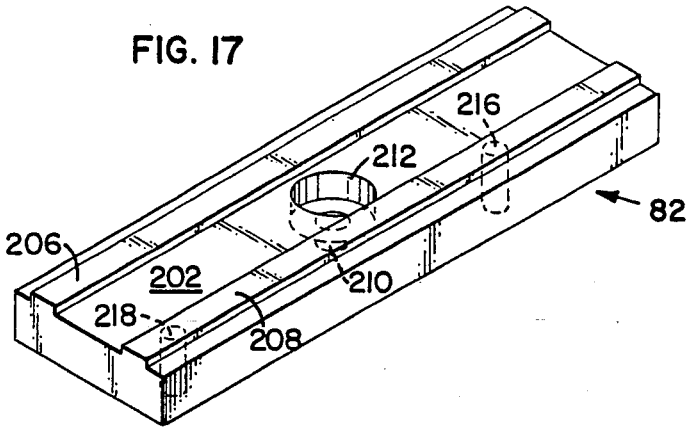
FIG. 17 is a perspective view of the armature shown in FIG. 15.

An additional feature can be added to any of the embodiments to prevent wings 18 from rotating after having been broken away (in an emergency, for example) and beginning to rotate again after the emergency has passed. The result would be a dangerous situation if the wings flapped around as the center shaft turned. The weight of the wings makes this hazardous. To eliminate this problem a proximity switch 410 (such as a reed switch) and its proximity element 412 (such as a magnet) are installed on the wing hanger 20 and wing 18 respectively, as shown in FIG. 18, or alternatively, on the drum ceiling 17 and adjacent side panel 14 respectively, as shown in FIG. 13. A mechanical switch would also be used. The switch would be wired in a series with the power circuit of the power rotation, such as described in U.S. patent application Ser. No. 374,899 filed 4 May 1982, which would turn shaft 16 and could have a latch circuit (as is well known in the art) to prevent power from returning to the rotation until the system was reset to prevent accidental restarting.

While the invention has been particularly shown and described with reference to preferred examples thereof, specifically, revolving doors, for example, it will be understood by those skilled in the art that various changes in form and details (such as use on the openings) may be made therein without departing from the spirit and scope of the invention.

What is claimed is:

1. In an electrically powered revolving door having door panels, side panels, and frames, the panels radially attached to a central shaft and having electrically operated release means for permitting said panels to pivot from their radial positions, the improvement comprising switch means mounted on at least one panel and frame for sensing the position of the panel and disconnecting power to a door rotating device when said panel and frame are not proximate each other.

2. A revolving door according to claim 1 including reset circuit means for preventing reenergization of said rotating device after being disconnected by said switch means, until physically reset.

* * * * *